US010533753B2

(12) United States Patent
Lando et al.

(10) Patent No.: US 10,533,753 B2
(45) Date of Patent: Jan. 14, 2020

(54) POT SUPPORT WITH ELASTIC FOOT AND METHOD FOR FIXING ELASTIC FOOT TO A POT SUPPORT

(71) Applicant: Electrolux Appliances Aktiebolag, Stockholm (SE)

(72) Inventors: Giuseppe Lando, Forli (IT); Oscar Alberto Salazar, Forli (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 24 days.

(21) Appl. No.: 15/119,925

(22) PCT Filed: Apr. 28, 2015

(86) PCT No.: PCT/EP2015/059160
§ 371 (c)(1),
(2) Date: Aug. 18, 2016

(87) PCT Pub. No.: WO2015/169638
PCT Pub. Date: Nov. 12, 2015

(65) Prior Publication Data

US 2017/0059178 A1 Mar. 2, 2017

(30) Foreign Application Priority Data

May 7, 2014 (EP) ..... 14167282

(51) Int. Cl.
*F24C 15/10* (2006.01)
*A47B 91/04* (2006.01)

(52) U.S. Cl.
CPC ..... *F24C 15/107* (2013.01); *A47B 91/04* (2013.01)

(58) Field of Classification Search
CPC ..... F24C 15/107; A47B 91/04
(Continued)

(56) References Cited

U.S. PATENT DOCUMENTS 1,356,797 A * 10/1920 Stock ..... A47B 91/04 16/39
1,843,261 A * 2/1932 Bales ..... A47B 91/04 16/42 T
(Continued)

FOREIGN PATENT DOCUMENTS

CN 201811317 U 4/2011
DE 202010010785 U1 11/2010
(Continued)

OTHER PUBLICATIONS

International Search Report issued in PCT/EP2015/059160 dated Jun. 15, 2015, 3 pages.
(Continued)

*Primary Examiner* — Anita M King
(74) *Attorney, Agent, or Firm* — Pearne & Gordon LLP

(57) ABSTRACT

The invention presents a solution to avoid glue when fixing an elastic foot to a pot support, such as used in ranges and kitchen hobs. The pot support (1000) has a cavity (2200) which is aligned with an elastic foot (1300) which comprises on the other hand a hollow space (3240). By inserting an expansion body (3220, 3450) into the hollow space, a press fit is generated between a support structure (1800) of the pot support and/or elastic material of the foot (1300). Rivets (3450) or bolts (3220) are taught as expansion bodies. The invention also teaches a method to mount an elastic foot to a pot support. The invention provides a solution for avoiding the deteriorating effects of aging glue used in the prior art, which leads to the loss of rubber feet on current pot supports.

15 Claims, 3 Drawing Sheets

(58) Field of Classification Search
USPC ..... 248/146, 188.8, 188.9, 677; 126/152 A
See application file for complete search history.

(56) References Cited

U.S. PATENT DOCUMENTS

| | | | | | |
|---|---|---|---|---|---|
| 2,764,970 | A * | 10/1956 | Carani | F24C 15/107 | 126/214 C |
| 2,849,201 | A * | 8/1958 | Schelgunov | A47B 91/00 | 16/42 R |
| 3,266,446 | A * | 8/1966 | Haydock | A47B 3/02 | 108/156 |
| 4,923,158 | A * | 5/1990 | Saisho | A47B 91/00 | 248/188.8 |
| 5,007,607 | A * | 4/1991 | Kim | A47B 81/06 | 248/188.9 |
| 5,153,052 | A * | 10/1992 | Tanaka | A47B 91/06 | 108/156 |
| 6,407,351 | B1 * | 6/2002 | Meyer | F16M 7/00 | 177/238 |
| 6,915,993 | B2 * | 7/2005 | O'Leary | A47B 91/06 | 248/188.8 |
| 7,762,506 | B2 * | 7/2010 | Beshore | A47B 91/06 | 16/42 T |
| 8,479,899 | B2 * | 7/2013 | Ohtake | F16F 1/371 | 188/129 |
| 9,612,021 | B2 * | 4/2017 | Wood | F24C 15/107 | |
| 2009/0044795 | A1 * | 2/2009 | Shaffer | F24C 15/107 | 126/215 |
| 2012/0048258 | A1 | 3/2012 | Sewell et al. | | |
| 2014/0251305 | A1 * | 9/2014 | Rasi | F24C 3/08 | 126/39 E |

FOREIGN PATENT DOCUMENTS

| | | | |
|---|---|---|---|
| DE | 102012214855 | A1 | 2/2014 |
| EP | 2048445 | A2 | 4/2009 |
| EP | 2253889 | A1 | 11/2010 |
| JP | 2004150670 | A | 5/2004 |
| JP | 2011002181 | A | 1/2011 |
| WO | 2004023043 | A1 | 3/2004 |
| WO | 2009121598 | A1 | 10/2009 |

OTHER PUBLICATIONS

Office action issued in corresponding Chinese Patent Application No. 201580013872.4 dated Apr. 4, 2018, with translation, 19 pages.
Translation of Second Office action issued in corresponding Chinese Patent Application No. 20150013872.4 dated Dec. 19, 2018, 11 pages.

* cited by examiner

POT SUPPORT WITH ELASTIC FOOT AND METHOD FOR FIXING ELASTIC FOOT TO A POT SUPPORT

In modern kitchen environments and in particular where flush-mounted hobs or ranges are used, it is beneficial to use pot supports usually made of cast iron material in order to keep a predetermined distance between a pot or a pan to be supported above a gas burner. Those supports usually secure the proper distance between the bottom of the cooking vessel and the flame while at the same time promoting a proper placement of the pot regarding efficiency of the gas distribution underneath it.

Usually cooking and preparing of food goes along with the spillage of fluids and thus, it is beneficial that pot supports can be removed in order to be cleaned. As a consequence, pot supports are usually centered around a gas burner and supported on a surface of a range or a hob or a workplate by elastic feet. The elastic feet provide proper dampening and rigid support of the pot support as well as thermal isolation between the surface on which they are positioned and the heat that is guided along the cast iron material of the pot support.

Generally, the elastic feet of a pot support are mounted to it by using a glue. However, due to the constant thermal stress caused by different expansion coefficients of the cast iron material and the elastic material of which the foot consists due to the intermittent heating and cooling processes in the typical use case of a kitchen hob, the glue connection deteriorates over time. This leads to a problem that after some time the feet are no more properly maintained within the pot support. This on the other hand leads to a deteriorated quality impression by the customer.

The German publication DE 10 2005 046589 A1 shows a pot support having foot elements which are consisting of rubber and are inserted into a bore of a basic body of the pot support.

The invention is based on the problem to improve the quality impression of a pot support and in particular the fixing of a foot of a pot support.

This problem is solved by the invention by a pot support according to claim 1 and by a method for mounting an elastic foot to a pot support according to claim 11.

Further developments of the invention are given in the dependent claims.

Advantageously, the pot support according to an embodiment of the present invention makes use of an expansion body that is inserted within an elastic foot in order to create a higher friction force between a cavity provided in the support structure and the elastic material of which the foot consists. In this manner, a secure connection between an elastic foot and the support structure of a pot support can be established without using glue. This has the advantage of a long-term stability of the mechanical connection as no chemical aging process takes place when such a structure is exposed to thermal stress. This is the case when a kitchen hob is used and a pot support is frequently heated and cooled down again due to the different thermal expansion coefficients of the elastic material and the usually used cast iron material of the support structure of the pot support.

Beneficially, according to a further development of an embodiment of the pot support according to the present invention, the elastic foot cooperates with a bore or a stud hole having a different diameter.

Beneficially, the first diameter of the stud hole of the bore being smaller than the second diameter of the elastic foot. In this manner, it is possible to secure an initial friction force between the walls of the bore respectively hole and the elastic foot that is then further increased by the expansion body.

Favorably, according to a further development of an embodiment of the pot support according to the present invention, the expansion body is larger than the hollow space in a manner that creates the press fit at least between the expansion body and the elastic material next to the hollow space. In this manner, the friction force between an elastic foot and a support structure can be increased, e.g. adjusted to a value that guarantees a secure fixture of the elastic foot within or to the support structure.

Beneficially, according to a further development of an embodiment of the pot support according to the present invention, the expansion body has the shape of a bolt. Bolts can easily be manufactured to a predefined diameter and are used in many industrial applications, which makes them cheap and reliable and widely available on the market. This renders them particularly suitable for an application in the household environment, which demands for reliability and availability as well as price performance.

Beneficially, according to a further development of an embodiment of the pot support according to the present invention, the expansion body is fixed within the cavity. In this manner, the elastic foot gets expanded while it is inserted into the cavity and thus an additional manufacturing step during the process of fixing the elastic feet to the support structure can be saved, e.g. the bolts can be an integral part of the support structure and be e.g. cast together with it during the iron casting.

Advantageously, according to a further development of an embodiment of the pot support according to the present invention, the expansion body can be constructed in the form of a rivet. Rivets are widely available on the market, and by selecting the dimension of a rivet, the final pressure between the elastic foot, the rivet, respectively the cavity or bore or hole can be exactly predetermined, once the rivet is in place. In this manner, it is possible to predetermine the friction force between the rivet, respectively the support structure, and the elastic foot.

Beneficially, according to a further development of an embodiment of the pot support according to the present invention, the rivet is in direct contact with the bore, while on the other hand expanding the elastic foot on the outside of the support structure in order to fix it thereto. In this manner, a highly stable metal-to-metal connection between the rivet and the cast iron support structure can be established, which produces a higher friction force, while at the same time not suffering the complications of largely different thermal expansion coefficients, and thus withstands thermal stress a lot better than other designs used in the prior art.

Advantageously, according to a further development of a pot support of the present invention, the elastic material is made of rubber. Rubber is a natural material and is highly stable over time and thus does not suffer deterioration of a rapid aging process giving thus a highly desired quality impression of the pot support to the customer.

Advantageously, the method according to an embodiment of the present invention is suitable to fix an elastic foot to a pot support in a minimum number of steps without using glue, thereby in a unique way enhancing the friction force between the foot and the support structure in using an expansion body that is inserted into a hollow space of the foot and thus presses it against a cavity, respectively a bore provided in the support structure in the pot support. In this way, a reliable connection in form of a press fit can be established between the elastic foot and the support structure while omitting glue and the disadvantageous effects of glue, especially its aging as a consequence of thermal stress in heating and cooling and different expansion coefficients between a metallic respectively cast iron structure at a rubber respectively elastic material.

Advantageously, according to a further development of an embodiment of the method of the present invention, the elastic material is pressed against a sidewall of a cavity. In this manner, the friction force can be more easily predetermined due to the known properties and dimensions of the sidewall respectively the elastic material as well as the expansion body. In this manner, the exact friction force can be efficiently predetermined and maintained during a manufacturing process.

Advantageously, according to a further development of an embodiment of the method according to the present invention, the expansion body can be prefabricated within the cavity, e.g. by means of a bolt that expands the elastic material, once the foot is inserted within a bore, respectively cavity, respectively stud hole. In this manner, a highly facilitated manufacturing process can be realized.

Advantageously, according to a further development of an embodiment of the method according to the present invention, the elastic foot can be pressed against a contact surface by the expansion body and thus secure a rigid connection between the support structure and the elastic foot, while at the same time within the cavity only a metal-to-metal contact is established.

Beneficially, according to a further development of an embodiment of the method according to the present invention, a rivet is used that is inserted into the hollow space and the cavity once the two are aligned. In this manner, an easy manufacturing process can be realized that at the same time allows it to predetermine the final friction force between the rivet and the support structure in a manner that a proper dimensioning of the rivet can be performed by pre-selecting it according to rivet variants available on the market suitable for that purpose.

Subsequently, the invention will be further explained on the basis of examples shown in drawings, wherein.

Figure 1:
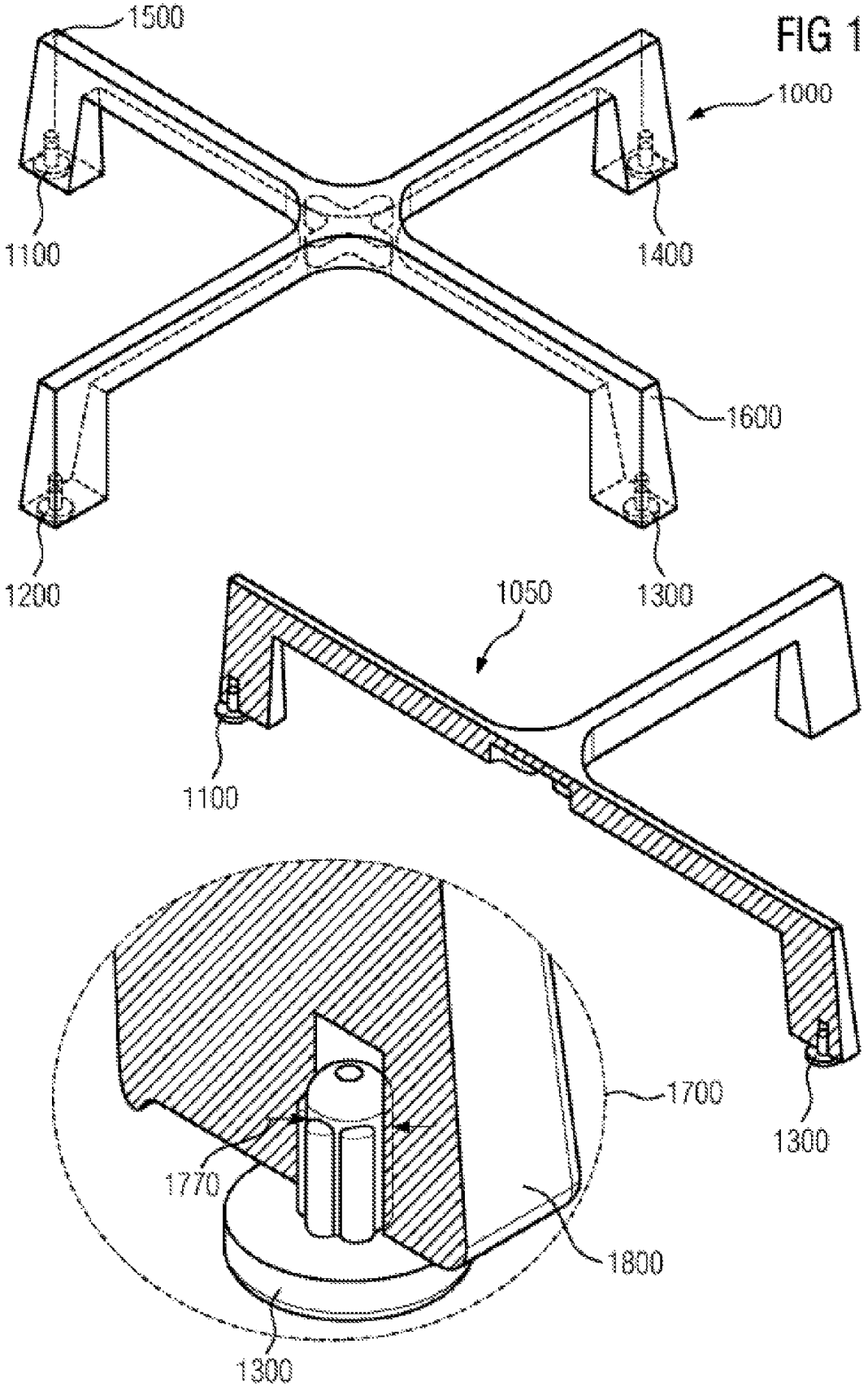
FIG. 1 shows a pot support.

As FIG. 1 shows in a preferred embodiment, a pot support 1000 may have four extensions that with a contact surface rest on a range, a hob or a flush-mounted hob in order to securely position a pot above a gas flame, for instance. Within a support structure, elastic feet 1100, 1200, 1300 and 1400 are maintained. Also shown is an access 1500, 1600 that shows where another example 1050 is cut. In a cut enlarged detail view 1700, an elastic foot 1300 is shown, which may be of any elastic material and especially made of rubber because rubber is highly time-stable and undergoes no particular rapid aging. In this case, the rubber foot has a cylindrical portion which has a diameter 1770. The cylindrical portion is inserted into a stud hole 1750. Also shown is a sidewall of the support structure 1800.

Figure 2:
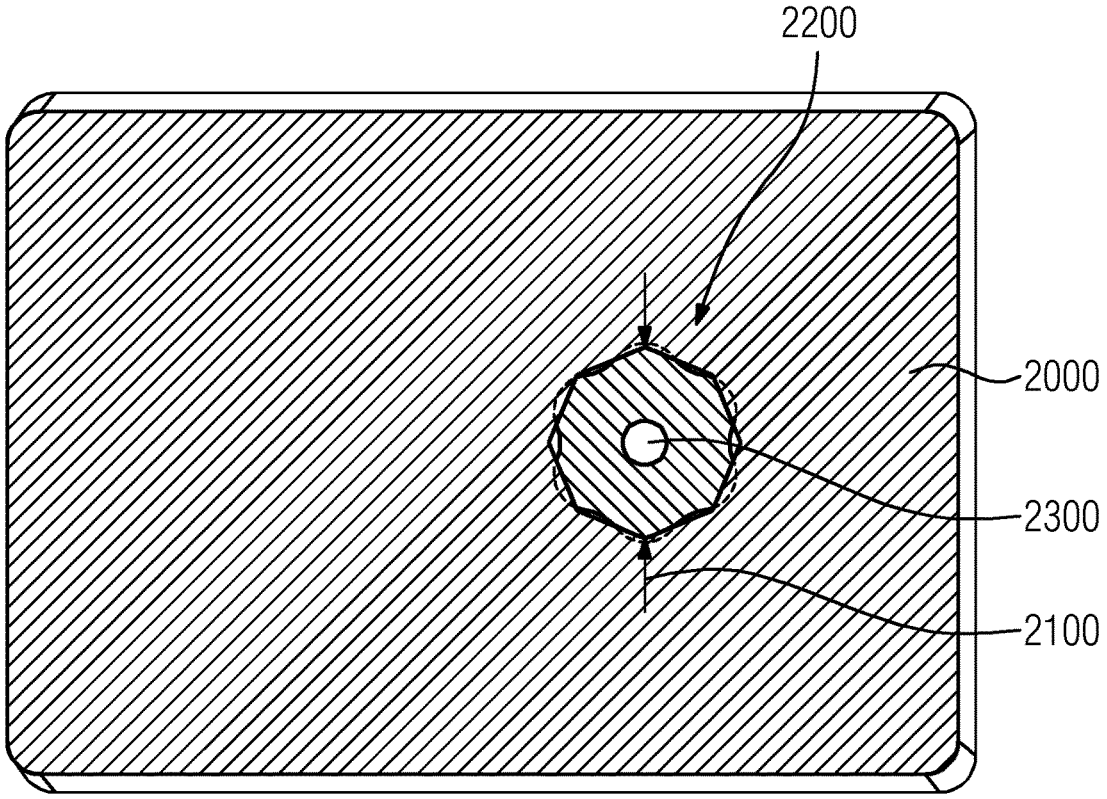
FIG. 2 shows another view of a pot support.
Figure 2:
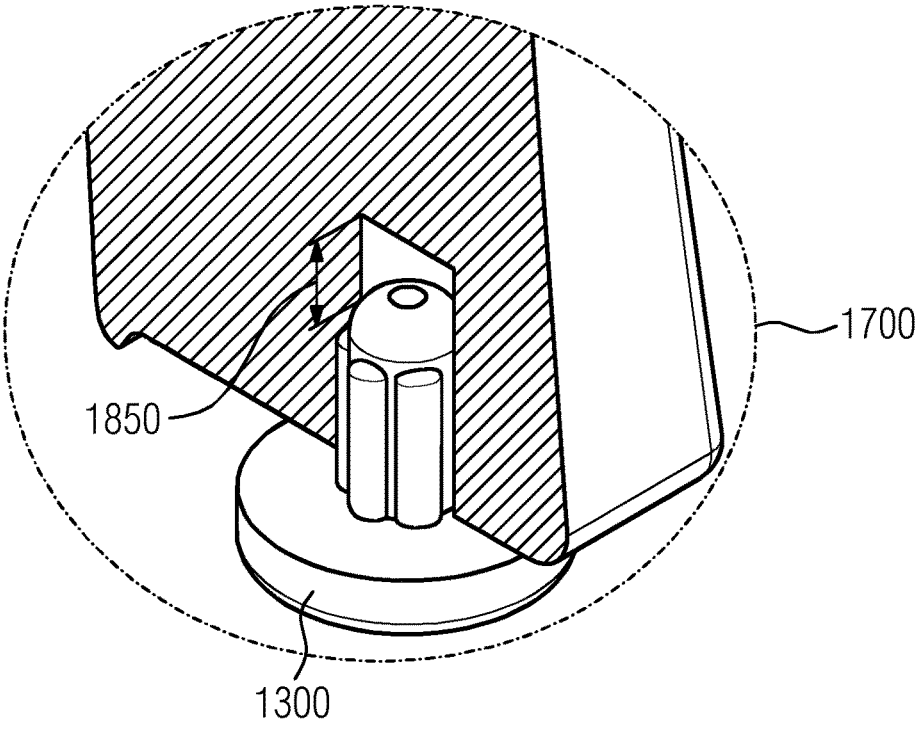

FIG. 2 shows a further detail of a pot support according to an embodiment of the present invention. In particular, the inventors have realized that secure connections between elastic feet and a support structure can be established without the use of glue. Here, a bottom contact surface of the support structure 1800 is shown which is identified by reference sign 2000. Within the support structure, a cavity, in this case a bore or a stud hole is provided 2200, which has a first diameter 2100. Also a bolt 2300 can be seen which is e.g. built into the stud hole respectively cavity 2200 and may enter a hollow space within an elastic foot to expand it once it is inserted into the stud hole 2200. In an enlarged view 1700, the elastic foot 1300 is shown, and its cylindrical portion has a distance 1850 to a top and of a stud hole. It is to be noted that the cavity where the elastic foot is inserted or supported does not have to be of a regular shape. On the other hand, it is easier to calculate a friction force between an elastic foot and a sidewall of the cavity built within a support structure in a predetermined manner in order to establish constant manufacturing conditions by providing feet and bores of a certain measurement relationship.

Figure 3:
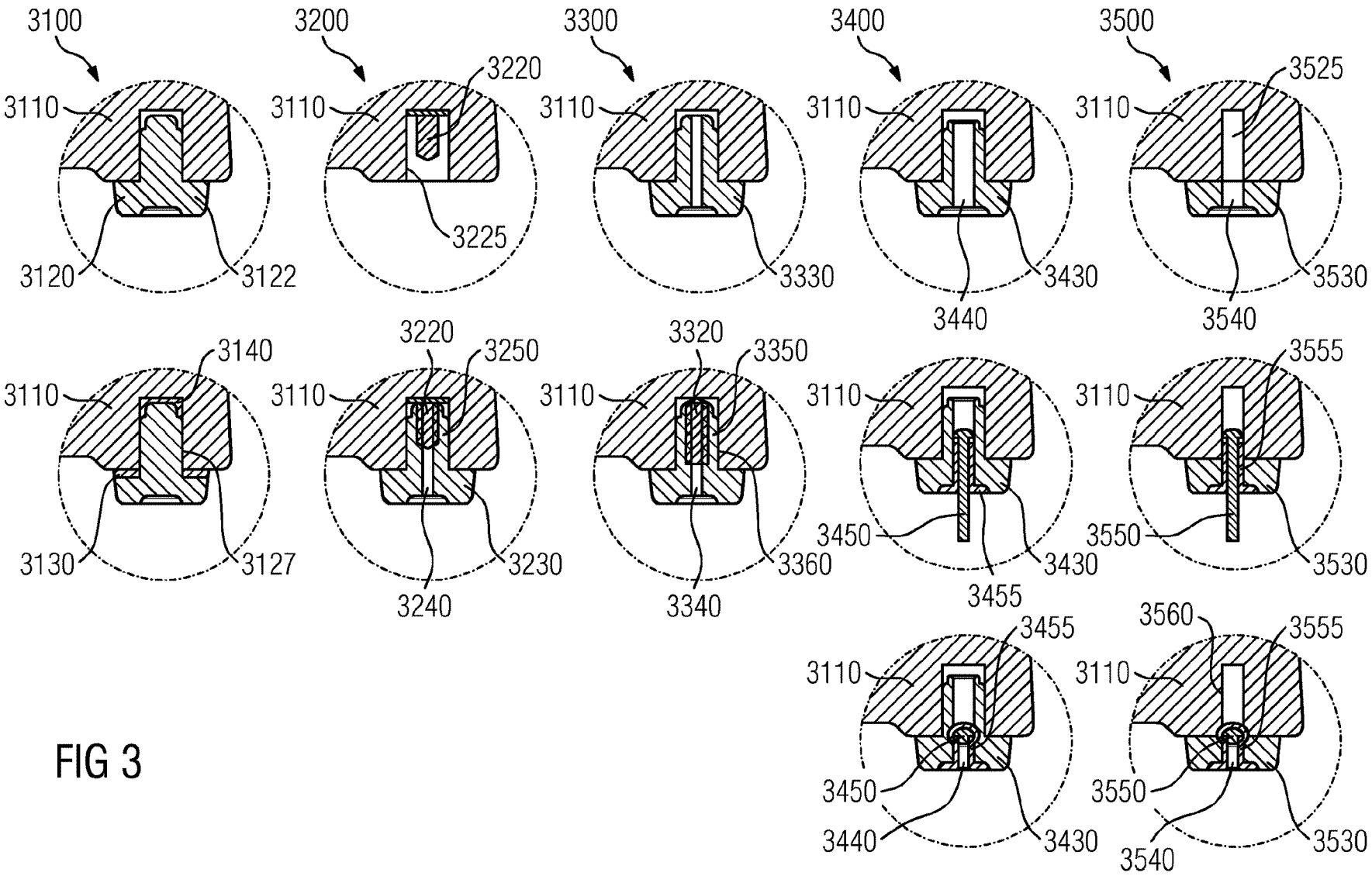
FIG. 3 shows a number of examples of feet secured to a pot support.

As FIG. 3 shows various examples of mounting an elastic foot to a support structure for forming a pot support are possible. The examples belonging to each other show various stages of the mounting process and those depicted above each other belong together to the same embodiment. In the example 3100, a support structure 3110 is shown and an elastic foot 3120 is inserted into the support structure 3110. The elastic foot has a circular pad-shaped portion 3122 and a cylindrical barrel-shaped portion 3127 which is inserted e.g. into a cavity respectively bore or stud hole of the support structure 3110. In case of the prior art example shown here, glue 3130 is used to fix the foot 3120 in the support structure 3110.

In another example 3200, a development according to an embodiment of the present invention is shown. Here, in the support structure 3110, a bolt 3220 is shown. This bolt 3220 may e.g. be a nail. On the other hand, this bolt may be formed during the iron casting of the support structure 110 together with it.

Further below, a foot 3230 is shown. It is inserted into a cavity 3225 and also features a hollow space 3240 that is here provided in a central symmetry axis and along with it. On the upper part, it can be seen that the bolt 3220 enters the hollow space 3240 of the foot and applies a pressure force to the elastic material in an area 3250. In this manner, the friction force between the elastic material in the area 3250 and applied to a sidewall of the cavity 3250 can be controlled by the dimensions of the bolt 3220 and dimensioned in such a manner that the foot 3230 will be reliably maintained by way of a press fit within the support structure 3110, no matter under which thermal conditions the pot support is operated and which thermal stress is created between the foot and the support structure.

At 3300, a similar example of an embodiment of the pot support according to the present invention is shown. Here, the bolt is not fixed to the support structure 3110. The elastic foot 3330 is inserted into a cavity into the support structure 3110 as shown and later a bolt 3320 is inserted into a central hollow space 3340 provided along a symmetry axis within the elastic foot 3330. In this manner, using the bolt 3320 as an expansion body, the elastic material will be pressed against the sidewall 3360 of the cavity in an area 3350 in order to securely fix the elastic foot to the support structure of the pot support. The insertion of bolt 3320 may be executed by means of a nail gun or a semi-automatic device or tool which increases the lead time in production lines over hand made processes.

In another example of the pot support according to a further development of an embodiment of the present invention 3400, an elastic foot in a similar manner as in the previous examples 3430 having a hollow space 3440 is inserted into a support structure 3110. In this case, however, a rivet consisting of a central part 3450 and an outer hollow cylindrical part 3455 is inserted into the hollow space 3440.

As further shown, the cylindrical part 2455 is expanded in a manner that it presses the elastic material of the foot 3430 against the support structure 3110.

By dimensioning the rivet according to the desired pressure after fixing it, the friction force between the support structure and the elastic foot 3430 can be exactly dimensioned in a manner that it is sufficient to maintain the elastic foot in position when the pot support is exposed to a usual temperature range in question for a kitchen hob or a range.

In a further development of an embodiment according to the present invention, the elastic foot shown in the example 3500 consists of a pad-shaped portion 3530 having a hollow space 3540 that is not inserted in the cavity or bore 3525. In this case, also a rivet consisting of an interior part 3550 and a hollow cylindrical part 3555 is inserted through the hollow space 3540 and then expanded. Here, as shown further below, the rivet is attached to a sidewall 3560 with its exterior part 3555. On the other hand, the hollow cylindrical part securely presses the pad-shaped portion of the elastic foot 3530 against a bottom surface of the support structure 3110. Thus, as shown above, various possibilities exist to fix and mount an elastic foot to a support structure of a pot support, respectively pan support.

LIST OF REFERENCE NUMERALS

1000 pot support;
1100, 1200, 1300, 1400 elastic feet;
1500, 1600 cut axis
1050 cut support structure;
1700 detailed enlarged view;
1800 support structure;
1770 diameter of cylindrical part of elastic foot
1750 cavity;
2000 bottom contact surface of support structure;
2100 diameter of cavity;
2200 cavity;
2300 expansion body;
1850 distance between top end of foot and top end of stud hole;
3100 prior art;
3110 support structure;
3120 elastic foot;
3122 pad-shaped portion of elastic foot;
3140 glue;
3130 glue;
3127 cylindrical portion of elastic foot;
3200 other development;
3220 bolt;
3225 sidewall of hole/bore;
3250 press-fit area;
3240 hollow space;
3230 pad-shaped portion of elastic foot;
3300 further example;
3330 elastic foot;
3320 bolt;
3340 hollow space;
3400 other example;
3440 hollow space;
3430 pad-shaped portion of elastic foot;
3455 cylindrical portion of rivet;
3450 bolt portion of rivet;
3500 other example;
3525 bore:
3535 pad-shaped portion of elastic foot;
3540 hollow space;
3555 hollow cylindrical portion of rivet;
3550 bolt portion of rivet;
3560 sidewall of bore in support structure 3110.

The invention claimed is:

1. A cooking appliance comprising:
a gas burner disposed at a cooktop surface; and
a pot support positioned above the gas burner and supported by the cooktop surface,
wherein the pot support comprises:
a support structure;
a contact surface;
a cavity within the support structure accessible through the contact surface;
a foot made from elastic material comprising a hollow space extending into the cavity, the foot being adapted to contact the cooktop surface to support the pot support thereon; and
an expansion body within the cavity and the hollow space, wherein the expansion body is larger than the hollow space, thus establishing at least a press fit of the elastic material.

2. The cooking appliance according to claim 1, wherein the cavity is a stud hole or a bore having a first diameter, the foot having a second diameter.

3. The cooking appliance according to claim 2, wherein the second diameter is larger than the first diameter.

4. The cooking appliance according to claim 1, wherein the expansion body is a bolt.

5. The cooking appliance according to claim 1, wherein the expansion body is fixed within the cavity.

6. The cooking appliance according to claim 1, wherein the expansion body is a rivet.

7. The cooking appliance according to claim 1, wherein the elastic material is rubber.

8. A cooking appliance comprising:
a gas burner disposed at a cooktop surface; and
a pot support positioned above the gas burner and supported by the cooktop surface,
wherein the pot support comprises:
a support structure;
a contact surface;
a cavity within the support structure accessible through the contact surface;
a foot made from elastic material comprising a hollow space, wherein the foot does not extend into the cavity, and wherein the foot is adapted to contact the cooktop surface to support the pot support thereon; and
an expansion body within the cavity and the hollow space, wherein the expansion body is a rivet.

9. The cooking appliance according to claim 8, wherein the rivet directly contacts a wall of the cavity.

10. A method for mounting a foot comprising elastic material to a pot support of a cooking appliance, wherein the cooking appliance comprises a gas burner disposed at a cooktop surface and the pot support is positioned above the gas burner and is supported by the cooktop surface, wherein:
in a first step, a hollow space of the foot and a cavity of the pot support are aligned; and
in a second step, an expansion body is inserted into the hollow space to form a press fit with the foot, wherein the expansion body is larger than the hollow space, thus establishing at least a press fit of the elastic material, the foot being adapted to contact the cooktop surface to support the pot support thereon.

11. The method according to claim 10, wherein the elastic material is pressed against a sidewall of the cavity.

12. The method according to claim 11, wherein the expansion body is a rivet that is fixed after the cavity and hollow space have been aligned.

13. The method according to claim 10, wherein the elastic material is expanded by a bolt fixed inside the cavity, when the foot is inserted into the cavity.

14. The method according to claim 10, wherein the foot is pressed against a contact surface by the expansion body.

15. The method according to claim 10, wherein in the first step, the hollow space of the foot and the cavity of the pot support are aligned such that the hollow space of the foot is positioned within the cavity.

* * * * *